US007124833B2

(12) United States Patent
Sant'Angelo

(10) Patent No.: US 7,124,833 B2
(45) Date of Patent: Oct. 24, 2006

(54) SYSTEM FOR DELIVERY OF BREATHABLE FIRE EXTINGUISHING GAS

(76) Inventor: Joseph Germano Sant'Angelo, 568 Parkside Ct., Allentown, PA (US) 18104

( * ) Notice: Subject to any disclaimer, the term of this patent is extended or adjusted under 35 U.S.C. 154(b) by 179 days.

(21) Appl. No.: 11/016,593

(22) Filed: Dec. 20, 2004

(65) Prior Publication Data

US 2005/0126796 A1 Jun. 16, 2005

Related U.S. Application Data

(63) Continuation-in-part of application No. 10/335,526, filed on Jan. 3, 2003, now Pat. No. 6,840,331.

(51) Int. Cl.

| | |
|---|---|
| ***A62C 11/00*** | (2006.01) |
| ***A62C 2/00*** | (2006.01) |
| ***A62C 13/62*** | (2006.01) |
| ***B05B 7/10*** | (2006.01) |

(52) U.S. Cl. ..... 169/30; 169/71; 169/72; 169/44; 239/400; 239/402

(58) Field of Classification Search ..... 169/30, 169/71, 24, 11, 44, 46, 53, 14, 16; 239/398, 239/400, 422

See application file for complete search history.

(56) References Cited

U.S. PATENT DOCUMENTS

| | | | | |
|---|---|---|---|---|
| 2,450,537 | A * | 10/1948 | Williamson | 169/11 |
| 3,438,445 | A * | 4/1969 | MacCracken | 169/44 |
| 4,311,198 | A * | 1/1982 | Vasquez | 169/11 |
| 4,807,706 | A * | 2/1989 | Lambertsen et al. | 169/45 |
| 5,327,732 | A * | 7/1994 | De Almeida | 62/50.2 |
| 5,507,350 | A * | 4/1996 | Primlani | 169/47 |
| 6,418,752 | B1 * | 7/2002 | Kotliar | 62/640 |
| 6,446,731 | B1 * | 9/2002 | Sorosky | 169/24 |
| 6,502,421 | B1 * | 1/2003 | Kotliar | 62/640 |
| 6,672,397 | B1 * | 1/2004 | Taylor | 169/12 |

* cited by examiner

*Primary Examiner*—Davis Hwu

(57) ABSTRACT

This invention relates to an improved portable system for the delivery of a breathable, fire extinguishing gas mixture to a fire zone. The gas mixture comprises a normally gaseous inert material, such as nitrogen, helium or argon; an oxygen containing gas; and carbon dioxide. The system includes a means for storing or generating the inert material, means for storing the carbon dioxide, means for generating or introducing the oxygen containing gas, and means for mixing the components. The system also includes means for heating, vaporizing and controlling the temperature and proportions of the components.

20 Claims, 3 Drawing Sheets

SYSTEM FOR DELIVERY OF BREATHABLE FIRE EXTINGUISHING GAS

This application is a Continuation-in-Part of U.S. application Ser. No. 10/335,526, filed Jan. 3, 2003 now U.S. Pat. No. 6,840,331.

This invention is directed to an improved system and apparatus for the delivery of a breathable, fire extinguishing gaseous mixture to a fire zone. More particularly, this invention comprises the means for delivering to a fire zone a breathable mixture of an inert material, carbon dioxide and oxygen that is capable of extinguishing a fire.

BACKGROUND OF THE INVENTION

When attempting to create in a fire zone a breathable, fire extinguishing gas mixture comprising an inert material, carbon dioxide and oxygen, one of the challenges is to ensure that there is an adequate quantity of oxygen in the fire zone in order to sustain mammalian life. When introducing only the inert material and carbon dioxide to the fire zone, there is a possibility that the combustion in the fire zone can consume the free oxygen originally present in the air and, thus, reduce the amount of oxygen in the fire zone below a level sufficient to support life. Accordingly, in accordance with my invention oxygen is included in the gas mixture delivered to the fire zone.

One of the general problems encountered in connection with fighting fires at substantial distances above grade level and using water as the fire extinguishing medium is the weight of the water in the hose or other means for delivering the water to the fire zone. In such situations it is generally not feasible to deliver water much above the seventh or eighth floor of a building. While it has been suggested is to use gaseous materials as the fire extinguishing media, there has been no portable means proposed for the delivery of breathable, fire extinguishing gaseous mixtures comprised of an inert material, carbon dioxide and oxygen to a fire zone.

When considering a portable system for delivering such a mixture to a fire zone several items must be addressed regarding the supply and/or storage of the components of the gas mixture and the admixing of the components of the final fire extinguishing, breathable mixture. Important items to be considered are the temperatures at which the various components are introduced into the system, the temperatures at which the various components liquefy or vaporize, the temperatures at which the various components freeze or solidify and the impact of the temperature of the mixture being delivered. Just as one example, while the temperature of the mixture being delivered to the fire zone can be quite low and not have an adverse impact on the fire extinguishing capability of the mixture, too low a temperature may be undesirable for any people in the fire zone. Additionally, the existence of relatively low temperatures (e.g., below 0° C. or even lower) may require the employment of specific materials in the delivery means. Thus, when very low temperatures are encountered, it becomes undesirable to employ standard fire hoses and other materials of construction must be used, such as, for example, metal conduits. Furthermore, when the temperature of the breathable, fire extinguishing mixture being delivered to the fire zone drops below 0° C. frost begins to form on the delivery means and any water from other hoses splashed onto the delivery means will freeze into ice on the delivery means. This adds additional weight to the delivery means and limits the height to which the delivery means can be lifted. Further, it permits the usual fire hose to remain flexible.

Thus when utilizing liquid nitrogen stored in the portable system of my invention, it is desirable that the liquid nitrogen be vaporized and raised to a temperature greater than the temperature at which carbon dioxide solidifies prior to admixing the vaporized nitrogen and the carbon dioxide. In this type of situation it is also desirable to insure that the temperature is above the freezing point of water (0° C.), thus preventing the formation of ice within the mixture, before having to pump or compress the mixture. Maintaining a temperature at this level will also permit the use of a normal fire hose as the delivery means, rather than heavy metal conduits. Additionally, it is advantageous that the mixture in the delivery means be at a temperature sufficiently high to prevent the formation of frost or ice on the delivery means.

The system of my invention addresses these challenges and provides an improved system for delivering the breathable, fire extinguishing mixture of an inert material, carbon dioxide and oxygen as described herein.

It has previously been suggested to employ various chemicals and mixtures of chemicals, particularly materials in gaseous form in connection with extinguishing fires. For example U.S. Pat. No. 1,926,396 discloses the use of halogen derivatives of hydrocarbons as fire extinguishing materials and suggests that such materials may be pumped from a container or used in pressure devices in which a low boiling compound is employed to create sufficient pressure to expel itself from the apparatus. The patent does not disclose the use of a mixture comprising an inert material, carbon dioxide and oxygen nor does it teach a portable means for dispensing the mixture, which means comprises separate storage vessels for the inert material and carbon dioxide and means for controlling the temperature of the components as they are mixed.

U.S. Pat. No. 2,450,537 describes an apparatus for delivering carbon dioxide to smother a fire by heating the carbon dioxide before introduction into the fire zone, thereby avoiding fogging. There is no mention of a breathable atmosphere much less a system designed to maintain a breathable atmosphere in the fire zone.

U.S. Pat. No. 3,438,445 discloses a system providing a fire fighting gas by burning a fuel and combining the combustion gases with nitrogen and air to produce a mixture of reduced oxygen content, for example about 8% or less. The patent does not recognize the criticality of ensuring a particular concentration of carbon dioxide to create a truly breathable mixture of reduced oxygen content and, thus, provides no apparatus to do so.

U.S. Pat. No. 3,486,562 disclosed an apparatus for detecting and extinguishing a fire in an enclosed environment. When a preselected temperature is reached in the enclosed environment, a heat sensor activates the means for evacuating the gaseous content of the enclosed environment to and accumulator which is at a much lower pressure than the enclosed environment. At the same time, means are provided for cutting off air and power to the enclosed environment, while nitrogen is being introduced to the enclosed environment in place of the evacuated gases.

U.S. Pat. No. 3,715,438 describes a combustion suppressant mixture consisting essentially of certain perfluoroalkane gases and from 16 to 36% oxygen, namely at least about 18% and preferably about 21%. The patent does not disclose or suggest the use of carbon dioxide as a critical component in the mixture and does not describe a portable apparatus for delivering a gaseous mixture.

U.S. Pat. No. 3,822,207 disclosed a fire-fighting composition. Chloropentafluorethane is a general purpose fire extinguishing agent of low toxicity. In a mixture with other halogenatedalkanes, especially bromo-chlorodiflouromethane and bromotriflouromethane, very effective extinguishing compositions may be made giving low concentrations of breakdown products in use against liquid fuel fires.

U.S. Pat. No. 3,840,667 discloses an oxygen-containing atmosphere which will not support combustion but will sustain mammalian life. The oxygen containing atmosphere comprises a mixture of sufficient oxygen to sustain mammalian life; an inert, stable, high heat capacity of polyatomic (perflouroalkane) gas in an amount which provides the oxygen-containing atmosphere with a total heat capacity per mole of oxygen of at least 40 calories per ° C. measured at 25° C. and constant pressure, and helium in an amount of from about 5% to the balance up to 100%. All percentages are in mole %. The atmosphere disclosed in the patent claims to be useful in sustaining mammalian life within any closed system wherein fire hazards would normally be present.

U.S. Pat. No. 3,844,354 also discloses chloropentafluorethane as an efficient and economic fire extinguishing agent for total flooding systems.

U.S. Pat. No. 3,893,514 disclosed a system and method of adding nitrogen under pressure to a confined area including a habitable atmosphere to suppress a fire without any deleterious effect on humans within the environment in which the fire is suppressed. In adding nitrogen to the confined area, the partial pressure of oxygen remains the same to human life, if necessary, whereas the percent by volume oxygen is lowered to a point which is not sufficient to support combustion of burning elements. Therefore, life is sustained while the fire is suppressed with any harmful effect on humans.

U.S. Pat. No. 4,311,198 describes an apparatus for removing smoke from an enclosure by means of a suction-blower unit capable of drawing smoke out of an enclosure or blowing smoke out on an enclosure. The patent also discloses introducing an inert gas, such as nitrogen, into the enclosure to replace the smoke and squelch combustion. The patent does not disclose creating a breathable mixture in the fire zone or the means of so doing.

U.S. Pat. No. 5,327,732 relates to a movable apparatus for storing liquid nitrogen, vaporizing liquid nitrogen and delivering the nitrogen to an oil well fire. There is no discussion of creating or maintaining a breathable atmosphere, particularly not one containing carbon dioxide.

U.S. Pat. No. 5,507,350 describes a method for fire fighting by delivering solid carbon dioxide to or near fire by means of firing capsules of carbon dioxide by means of standard artillery guns. The method apparently works by smothering the fire with carbon dioxide and lowering temperature in the fire area. The patent does not address the question of maintaining a breathable atmosphere in the fire zone. Further, the artillery gun of the patent does not even remotely resemble my system.

U.S. Pat. No. 6,446,731 B1 discloses a self propelled vehicle designed primarily for the removal of smoke from fire zones, but also states that the same apparatus can be used after smoke removal to deliver fire extinguishing materials, such as dry chemicals, water or carbon dioxide, to the fire. The patent does not address the issue of maintaining a breathable atmosphere in a fire zone and does not disclose an apparatus resembling that of the present application.

Thus the suggestions of the prior art do not fully address the creation of a system for the delivery of a breathable, fire extinguishing mixture as defined by my invention.

SUMMARY OF THE INVENTION

Essentially, my invention is directed to a transportable system for delivering to an enclosed fire zone a breathable, fire extinguishing gas mixture. The gas mixture of the invention comprises a normally gaseous, inert material, carbon dioxide and oxygen. As used herein, the term inert material is means to describe a material that will not support combustion and will not break down into toxic materials. The system itself can comprise a source of the inert material, including a means for generating the inert material or a first storage vessel for the inert material, a source of carbon dioxide, including a second storage vessel for the carbon dioxide and a means for introducing an oxygen containing gas to the mixture. The system also includes a means for delivering the gaseous mixture to the fire zone. The system operates to deliver to the fire zone a gaseous mixture wherein of the normally gaseous inert material is present in the gaseous proportion of from about 80 to about 88% by volume of the total mixture. The carbon dioxide is present in the gaseous proportion of from about 2 to about 5% by volume of the total mixture. The oxygen is present in the gaseous proportion of from about 10 to about 15% by volume of the total mixture.

DETAILED DESCRIPTION OF THE INVENTION

The source of the inert material can be a means for generating or storing the inert material on site. The inert material can be any material that will not support sustained combustion of the fuel. Illustrative of such materials is, for example, nitrogen, helium, argon, and mixtures of these materials. While all of these materials are operative in my invention, I prefer to use nitrogen because of cost and availability.

Thus, for example, when the inert material is nitrogen, the means for generating nitrogen can be any of the well-known devices readily available in the industry. Illustrative of devices of this type are pressure swing adsorption (PSA) units, vacuum swing adsorption (VSA) units, and membrane units. In all of these illustrative devices, air (ambient or otherwise) is processed within the device so as to produce a nitrogen rich stream and an oxygen rich stream using techniques well known in the art. Using devices of these types it is possible to generate on site streams containing greater than normal concentrations of nitrogen, with concentrations of nitrogen greater than 90% by volume being easily obtainable. Conversely, these devices also produce streams containing greater than normal concentrations of oxygen. Thus, it is possible for these devices to produce both a high nitrogen (inert material), low oxygen stream and a high oxygen (oxygen containing gas), low nitrogen content stream).

When the source of the inert material is a first storage vessel for the inert material, the first storage vessel can be any vapor tight container for holding the inert material, including a vessel for containing the inert material in a gaseous form as well as a cryogenic storage vessel for holding the inert material in liquid form. Depending upon the temperature of the inert material in the first storage vessel, the system of my invention can also include a means for heating the inert material. When the first storage vessel is a cryogenic storage vessel and the inert material is stored in liquid form, the heating means can be a means for vaporizing the liquid inert material and for controlling the temperature of the vaporized inert material.

The means for heating the liquid inert material can be a heating means, such as, for example an electric heater, or a means for contacting the inert material, either directly of indirectly, with a warmer material. Thus, the heating means can be simply a chamber for mixing the inert material with a warmer material, such as, for example, ambient air, or it can be an indirect heat exchanger of the types well known in the art where the inert material and the warmer material are not intermixed, but heat is transferred from the warmer material to the cooler inert material. When the inert material is in liquid form and the first storage vessel is a cryogenic vessel, the use of a heater or heat exchanger is important. Readily available warmer materials can include ambient air, water and engine exhaust. To illustrate this aspect of my invention, if the inert material is liquid nitrogen, which must be at a temperature of less than about −200° C. at ambient pressure, the liquid nitrogen must be vaporized and raised to a temperature greater than the temperature at which carbon dioxide solidifies under the conditions of the system (about −65° C. or greater) so that after mixing the inert material (nitrogen) with the carbon dioxide conditions are maintained that prevent solidification of the carbon dioxide. As will be understood, it is desirable to avoid the formation of solids in a gas-handling system.

This heating of the inert material can be accomplished by admixing the inert material with ambient air. Such heating and vaporization of the liquid inert material can also be accomplished by effecting an indirect heat exchange between the inert material and a warmer material, such as, for example water, ambient air and engine exhaust. The selection of the particular warmer material can be based upon the temperature of the inert material, the desired rate of temperature increase, the heat capacity of the warmer material, and the economics of the operation.

In accordance with my invention, the source of carbon dioxide can be a second storage vessel that is capable of storing the carbon dioxide in solid, liquid, gaseous or supercritical forms. I prefer to introduce the carbon dioxide in gaseous form. As mentioned above, it is preferable to ensure that the temperature of the inert material or other components of the mixture is greater that the temperature at which carbon dioxide solidifies prior to combining the carbon dioxide and the inert material or other components of the mixture.

When the oxygen containing gas employed in my invention is ambient air, it is preferred that the temperature of the gas or gasses to which the air is being added be at a temperature greater than the freezing point of water. The reason for this is to avoid the formation of ice by the small quantity of water usually present in ambient air. While this can be accomplished by raising the temperature of the inert material to this level prior to mixing with the carbon dioxide, I prefer to use a multi-stage means for increasing the inert material to a first temperature greater than the temperature at which carbon dioxide solidifies and then raising the temperature of the mixture of the inert material, oxygen and carbon dioxide to a temperature greater than the freezing point of water at the conditions of the system. This is usually a temperature greater than 0° C. Desirably this temperature is not greater than about 35° C.

In the operation of the system of my invention I prefer that the inert material is nitrogen and the oxygen-containing gas is either ambient air or an oxygen containing stream from a PSA, VSA or membrane unit. I also prefer that the carbon dioxide be in gaseous form when introduced into the system.

I particularly prefer that the inert material be nitrogen and be in the form of liquid nitrogen stored in a first cryogenic storage vessel and that the liquid nitrogen be heated and vaporized and heated to a temperature greater than that at which carbon dioxide solidifies. This can be accomplished in a first stage means for increasing the temperature of the nitrogen, such as, for example, by means of a heater, such as an electric heater, or by heat exchange with a warmer material or by mixing with a warm oxygen containing stream (e.g., ambient air or an oxygen containing stream from a device such as a PSA, VSA or membrane unit. The vaporized nitrogen can then be admixed with gaseous carbon dioxide.

In accordance with my invention the oxygen containing ambient air can be introduced into the mixture of vaporized nitrogen and carbon dioxide either before or after increasing the temperature further in a second stage means for increasing the temperature. Again this second stage means for increasing temperature can be a heater, such as an electric heater, or by heat exchange with a warmer material. In fact, the temperature of nitrogen and carbon dioxide can be increased by blending in air at ambient or higher temperatures. In any event, the temperature of the mixture of vaporized nitrogen, gaseous carbon dioxide and oxygen is raised to a temperature greater than that at which ice forms (e.g., 0° C.) prior to the delivery of the gaseous mixture to the delivery means for delivering the nitrogen, carbon dioxide and oxygen containing air to the fire zone.

The system of my invention also includes a means for mixing the inert material, the carbon dioxide and the oxygen containing gas to form the breathable mixture.

In the operation of the system of my invention, it is desirable that the fire extinguishing gas mixture contain from about 83% by volume inert material and preferably at least about 84% by volume inert material. Usually the inert material will comprise less than about 87 and preferably less than about 86% by volume of the mixture. It is also usual that the concentration of carbon dioxide is at least about 2% by volume and preferably less than about 3% by volume of the mixture. Further, the oxygen concentration in the fire extinguishing mixture is at least about 11% by volume and preferably at least about 12% by volume. Finally the oxygen concentration in such mixture is less than about 14 and can be less than about 13% by volume.

DRAWINGS

Figure 1:
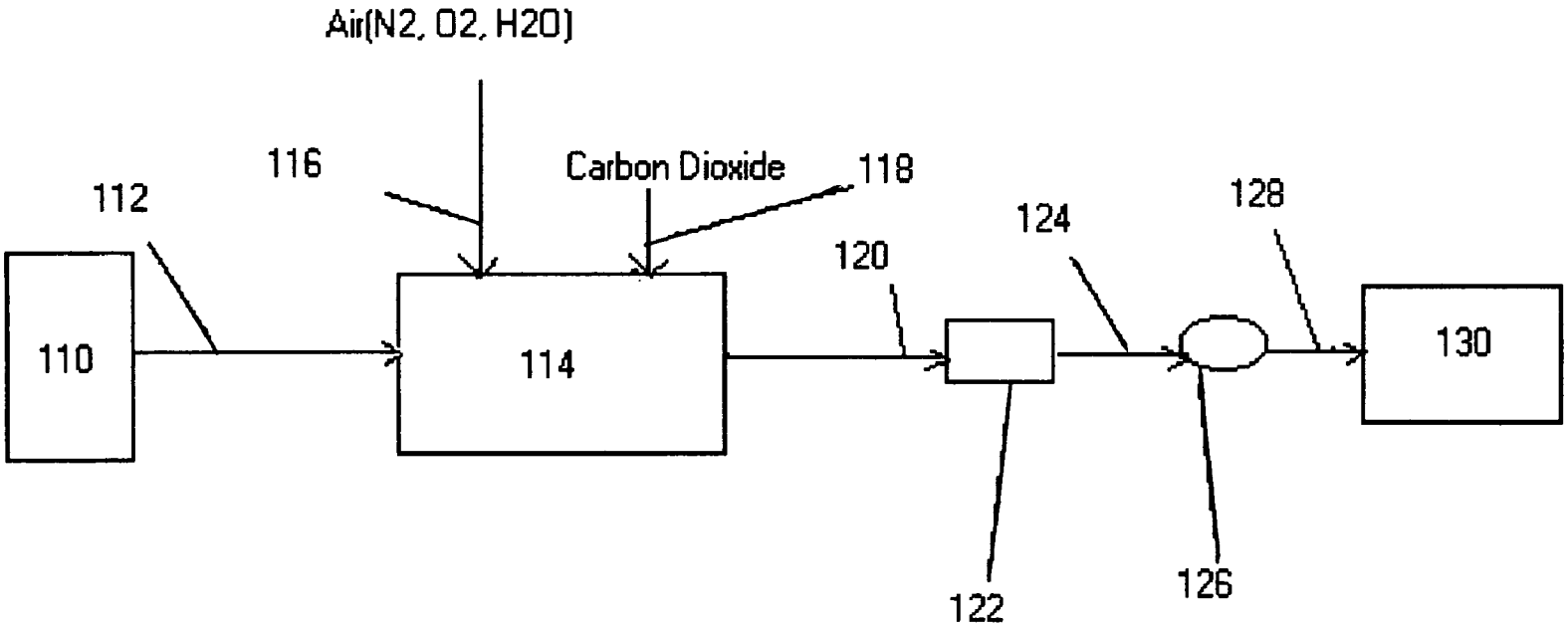
FIG. 1 is a schematic diagram illustrating a simple form of the system of my invention.

In FIG. 1 there is shown an embodiment of my invention wherein there is a first source of the normally gaseous inert material 110. In this Figure the system of my invention will be illustrated employing nitrogen as the inert material. Thus, this first source of the inert material can be a vapor tight storage vessel containing nitrogen gas under pressure or it can be a means for generating a nitrogen rich stream, such as a pressure swing adsorption (PSA) unit, a vacuum swing adsorption (VSA) unit, or a membrane unit. This nitrogen or nitrogen rich, oxygen poor stream at substantially ambient temperature is passed by means of line 112 into mixing zone 114. There is also introduced into mixing zone 114 a stream of ambient air containing oxygen, nitrogen and a small amount of water vapor by means of line 116. Also introduced into mixing zone 114 is a stream of carbon dioxide by means of line 118. The carbon dioxide can be in gaseous or liquid form at the moment of introduction. Thus, for example, the carbon dioxide can be stored in liquid form at a pressure of 300 to 600 psig and the liquid will first go to the vapor phase and then the solid state, from which it will sublime to the gaseous state in mixing zone 114. In mixing zone 114, the gases of lines 112, 116 and 118 are combined and mixed so as to provide a breathable fire extinguishing mixture of gasses.

In the case of using a PSA, VSA or membrane unit as the source of inert material 110, the composition of the gas in line 112 can be typically at least about 90% by volume nitrogen. The air of line 116 is also typically about 79% by volume nitrogen, about 21% by volume oxygen and a small amount of water vapor. The relative quantities of the gasses of lines 112, 116, and 118 are controlled so as to produce the breathable fire extinguishing gas mixture. In a typical situation the gas mixture exiting mixing zone 114 by means of line 120 is about 85.5% by volume nitrogen, about 11.5% by volume oxygen, and about 3% by volume carbon dioxide.

Also shown in this Figure is a heating device 122, which can be, for example, an electric heater or a heat exchanger, wherein the gas of line 120 can be heated to a temperature greater than 0° C., if necessary. Thus, for example, if the ambient air introduced by means of line 116 is at a temperature less than 0° C., it is desirable to insure that the breathable mixture of line 120 is at a temperature greater than the freezing point of water to prevent ice formation on any conduit transporting the breathable mixture. The breathable mixture at a temperature greater than 0° C. is transported by means of line 124.

Additionally, shown in FIG. 1 is a compressor or pump 126. In the event that the breathable mixture must be transported to a significant elevation, it may be necessary to utilize a pump or compressor to assist in moving the breathable mixture. Thus, the breathable mixture of line 124 is passed to compressor/pump 126 prior to introduction into delivery means 128 for delivery to the fire zone 130. The delivery means 128 can be any of the delivery means well-know to the art including an ordinary fire hose and specifically those delivery means described in my co-pending application Ser. No. 10/335,526.

The system described above in connection with FIG. 1 is capable of being mounted on or in any of the well-known means of transportation operable on land, sea or air, such as, for example, a truck, a boat or a helicopter.

Figure 2:
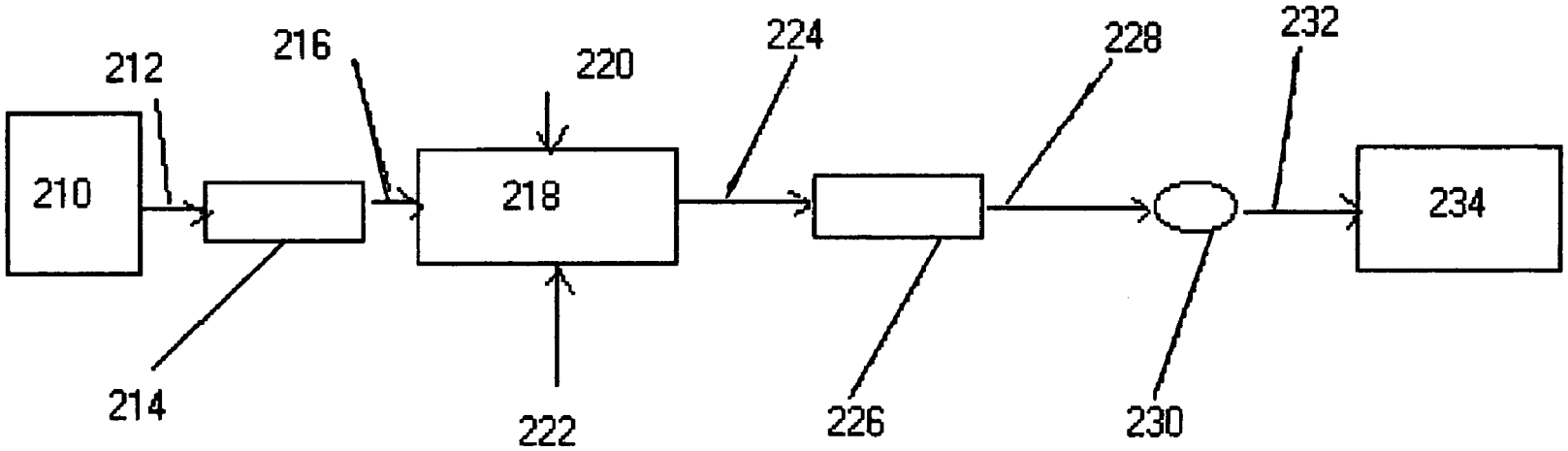
FIG. 2 is a schematic diagram illustrating a system of my invention wherein the inert material is stored in a liquid form.

In FIG. 2 is shown a cryogenic storage vessel 210 containing liquid nitrogen at a temperature of less than about −200° C. The liquid nitrogen is passed by means of line 212 to electric heater 214. In heater 214 the liquid nitrogen is heated to a temperature above its vaporization temperature, for example above about −190° C., in order to increase the temperature and to vaporize the nitrogen. The gaseous nitrogen is then passed by means of line 216 into mixer 218. Ambient air is also introduced by means of line 220 and admixed with the nitrogen in mixer 218 to form a gaseous mixture. Introducing ambient air not only introduces oxygen into the gaseous mixture, but also functions to increase further the temperature of the gaseous mixture. Alternatively, output streams from PSA, VSA or membrane units can be introduced via line 220. This provides the opportunity to control the oxygen and nitrogen contents of the mixture formed in mixer 218 by employing such output streams of varying higher or lower oxygen and nitrogen contents. At this point the temperature of the gaseous mixture is now greater than the temperature at which carbon dioxide solidifies (greater than about −65° C. at atmospheric pressure).

Gaseous carbon dioxide is introduced into mixer 218 by means of line 222. The amounts of gaseous nitrogen, oxygen containing gas and carbon dioxide introduced into mixer 218 are mixed so as to provide a breathable, fire extinguishing mixture comprising about 85.5% by volume nitrogen, about 3% by volume carbon dioxide, and about 11.5% by volume oxygen. This breathable mixture is withdrawn from mixer 218 by means of line 224 and passed to heat exchanger 226 wherein it is exchanged against a warmer material, such as, for example, air, water, or engine exhaust wherein it is heated to a temperature greater than the freezing point of water (0° C.). This is particularly desirable if the temperature of the nitrogen in line 216 is sufficiently low and the quantity and temperature of the ambient air introduced by means of line 220 are sufficiently low so that the temperature of the gaseous mixture, while being greater than the solidification point of carbon dioxide is still below the freezing point of water. This is a particularly likely event when the temperature of the ambient air introduced by means of line 220 is less than 0° C.

The heated breathable mixture is then withdrawn from heater 226 by means of line 228 and passed to compressor 230 where the pressure of the mixture is increased prior to introduction into the delivery means 232. This permits the delivery of the mixture to the fire zone 234 even if the fire zone is many stories high in a building. Due to the fact that the mixture is gaseous, it is much lighter than water and the delivery means 232 can be hundreds of feet high. Also, by insuring that the mixture introduced into the delivery means 232 is above the freezing point of water, frost will not form on the delivery means 232 and water splashed from other efforts at fire fighting in the area will not freeze on the delivery means 232. Thus, the delivery means 232 is not weighed down by ice formation, thus insuring that the delivery means 232 can be of extensive length and height. Further, typical fire hoses will remain flexible.

Figure 3:
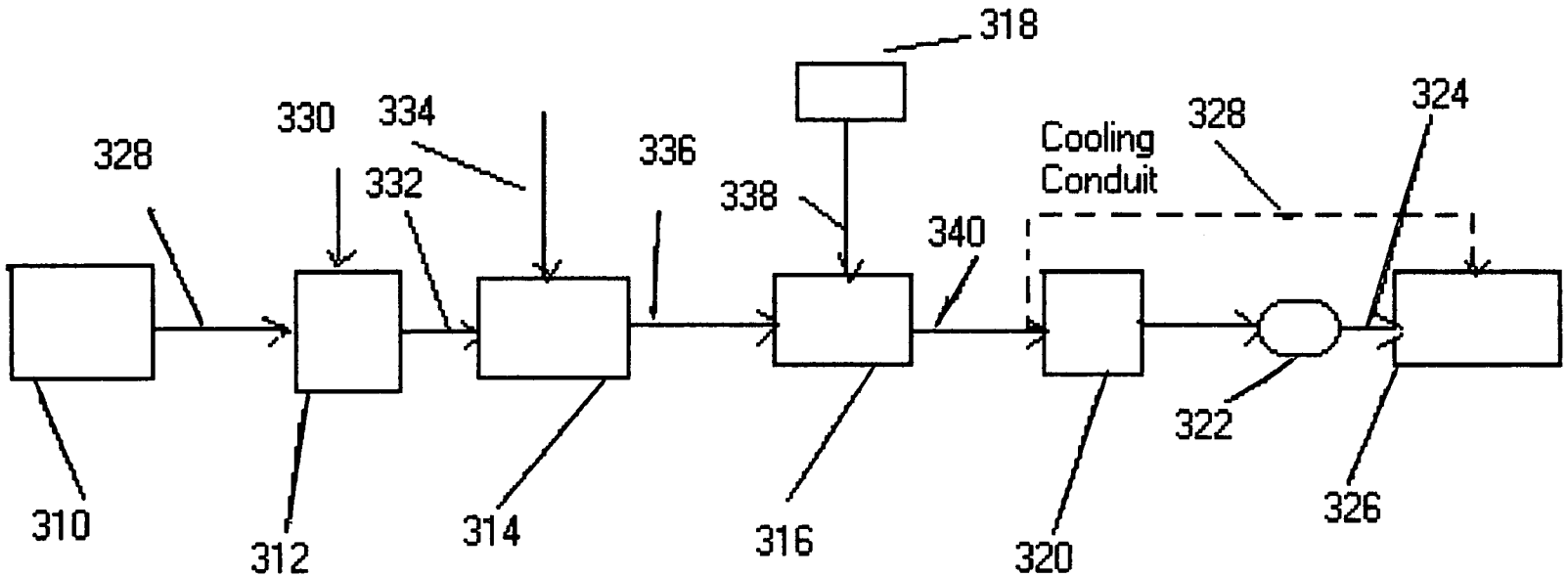
FIG. 3 is a schematic diagram illustrating a particularly preferred system in accordance with my invention.

FIG. 3 illustrates a preferred system in accordance with my invention. This system comprises a cryogenic storage vessel 310, a heat exchanger 312, a first mixing chamber 314, a second mixing chamber 316, a second storage vessel 318, a heater 320, a compressor 322, and a delivery means 324. A fire zone is shown at 326.

In operation this system contains liquid nitrogen in cryogenic storage vessel 310 which is passed by means of line 328 into heat exchanger 312 wherein it is indirectly heat exchanged against engine exhaust introduced into heat exchanger 312 by means of line 330 in order raise the temperature of the nitrogen to a temperature above the boiling point of nitrogen (about −200° C.) and preferably higher, thereby vaporizing the nitrogen. The nitrogen gas is than passed to the first mixing chamber 314 by means of line 332.

In first mixing chamber 314, the nitrogen gas is mixed with ambient air that is introduced to mixing chamber 314 by means of line 334. This mixing acts to heat further the nitrogen gas so as to form a mixture of the nitrogen gas and the oxygen, nitrogen and water of the ambient air at a temperature greater than the solidification temperature of carbon dioxide (for example greater than about −65° C.). Alternatively, output streams from PSA, VSA or membrane units can be introduced via line 334. This provides the opportunity to control the oxygen and nitrogen contents as well as the temperature of the mixture formed in mixer 314 by employing such output streams of varying higher or lower oxygen and nitrogen contents. This mixture is then passed to second mixing chamber 316 by means of line 336.

Carbon dioxide from second storage vessel 318 is introduced to second mixing chamber 316 by means of line 338 and is admixed with the nitrogen and air mixture of line 336 to form a breathable mixture containing nitrogen, oxygen and carbon dioxide, wherein the nitrogen is present in the amount of 83% by volume, the oxygen is present in the amount of 14% by volume and the carbon dioxide is present in the amount of 3% by volume. This mixture is removed from second mixing chamber 316 by means of line 340 and passed to electric heater 320.

Electric heater 320 functions to raise the temperature of the breathable mixture of line 340 to a temperature greater than the freezing point of water (0° C.) and preferably higher, for example +20° C. This heated breathable mixture is then passed from heater 320 to compressor 322 wherein it is increased to a pressure sufficient to drive the breathable mixture through delivery means 324 into fire zone 326. This permits the breathable mixture to be transported through the delivery means 324 to substantial elevations (greater than 10 floors) while at a temperature sufficient to prevent the formation of frost or ice on the delivery means 324.

FIG. 3 also shows a cooling conduit 328 which functions to by pass heater 320 and deliver the breathable fire extinguishing mixture of nitrogen, oxygen and carbon dioxide to the fire zone 326 at a cooler temperature. This can be a desirable system for cooling down hot spots in the fire zone after the initial fire has been extinguished. This operates to prevent flare-ups of the fire.

I claim:

1. A transportable system for delivering to an enclosed fire zone a breathable, fire extinguishing gas mixture, which gas mixture comprises a normally gaseous inert material, carbon dioxide, and oxygen and which system comprises a first source of the normally gaseous inert material, a second source of the carbon dioxide, a third source of an oxygen containing gas, means for mixing the inert material, the carbon dioxide and the oxygen containing gas, and a delivery means for delivering the inert material, the carbon dioxide and the oxygen containing gas to the fire zone, the normally gaseous inert material, the carbon dioxide and the oxygen containing gas being delivered to the fire zone in the gaseous proportions of from about 81 to about 88% by volume normally gaseous inert material, of from about 2 to about 5% by volume carbon dioxide and of from about 10 to about 15% by volume of oxygen.

2. The transportable system of claim 1, wherein the first source of the inert material is a generator of the inert material.

3. The transportable system of claim 1, wherein the first source of the inert material is a first storage vessel for the inert material.

4. The transportable system of claim 3, wherein the first storage vessel for the inert material is a cryogenic vessel which stores the inert material in liquid form.

5. The transportable system of claim 4, wherein the system also contains a means for vaporizing the liquid inert material and controlling the temperature of the vaporized inert material.

6. The transportable system of claim 5 wherein the means for vaporizing and controlling the temperature of the inert material comprises a means for heating the inert material.

7. The transportable system of claim 6 wherein the means for heating the inert material is selected from the group consisting of a heating device, a means for exchanging the inert material against a warmer material, and means for blending the inert material with a warmer material.

8. The transportable system of claim 6 wherein the temperature of the vaporized inert material is raised to a temperature greater than the temperature at which carbon dioxide solidifies before contacting the vaporized inert material with the carbon dioxide.

9. The transportable system of claim 6 wherein the inert material in the first storage vessel is liquid nitrogen, the liquid nitrogen is vaporized and raised to a temperature greater than the temperature at which carbon dioxide solidifies in a first stage means for increasing the temperature of the nitrogen, the oxygen containing gas is air and the air and carbon dioxide are admixed with the vaporized nitrogen at the increased temperature, and the admixture of nitrogen, air and carbon dioxide is further raised to a temperature greater than about 0° C. in a second stage means for increasing the temperature of the admixture, and the admixture is delivered to the fire zone by the delivery means.

10. The transportable system of claim 6 wherein the inert material in the first storage vessel is liquid nitrogen, the liquid nitrogen is vaporized in a first stage means for increasing the temperature of the nitrogen, the oxygen containing gas is air and the temperature of the vaporized nitrogen is further increased to a temperature greater than the temperature at which carbon dioxide solidifies by introducing air to the vaporized nitrogen via the means for introducing an oxygen containing gas to form a mixture of nitrogen and air, admixing carbon dioxide from the second storage vessel with the nitrogen and air mixture to form the fire extinguishing gas mixture, further raising the temperature of the fire extinguishing gas mixture in a second stage for increasing the temperature of such gas mixture to a temperature greater than about 0° C., and such gas mixture is delivered to the fire zone by the delivery means.

11. The transportable system of claim 10 wherein the gas mixture delivered to the fire zone comprises from about 84 to about 86% by volume of nitrogen, from about 2 to about 3% by volume of carbon dioxide, and from about 12 to about 13% by volume of oxygen.

12. The transportable system of claim 1 wherein the source of carbon dioxide is vessel for storing carbon dioxide which can store the carbon dioxide in a form selected from a group consisting of solid, liquid, gaseous and supercritical form.

13. The transportable system of claim 1 wherein the fire extinguishing gas mixture contains of from about 83 to about 87% by volume of the normally gaseous inert material, of from about 2 to about 3% by volume of carbon dioxide and of from about 11 to about 14% by volume oxygen.

14. The transportable system of claim 1 which also contains a means for mixing the inert material, the carbon dioxide and the oxygen containing gas to form the breathable mixture.

15. The transportable system of claim 1 wherein the inert material is nitrogen and the oxgyen containing gas is air.

16. The transportable system of claim 1 wherein the normally gaseous inert material; is selected from the group consisting of nitrogen, helium and argon.

17. The transportable system of claim 16 wherein the normally gaseous material is nitrogen and the source of the nitrogen is selected from the group consisting of a pressure swing adsorption unit, a vacuum swing adsorption unit and a membrane unit.

18. The transportable system of claim 17 wherein oxygen containing gas is obtained from a source selected from the group consisting of a pressure swing adsorption unit, a vacuum swing adsorption unit, a membrane unit and ambient air.

19. A transportable system for delivering to an enclosed fire zone a breathable, fire extinguishing gas mixture, which gas mixture comprises nitrogen, carbon dioxide and oxygen and which system comprises:

a first cryogenic storage vessel for storing the nitrogen in liquid form;

a second storage vessel for storing the carbon dioxide;

a source of an oxygen containing gas selected from the group consisting of ambient air and an oxygen containing stream obtained from a device selected from the group consisting of a pressure swing adsorption unit, a vacuum swing adsorption unit and a membrane unit;

Means for heating the liquid nitrogen to vaporize it and form gaseous nitrogen;

means for mixing the gaseous nitrogen with the oxygen containing gas thereby further heating the nitrogen and controlling the proportions of oxygen and nitrogen in the nitrogen and oxygen mixture so formed;

means for further heating the nitrogen and oxygen mixture to a temperature greater than the solidification temperature of carbon dioxide;

means for introducing the carbon dioxide into the nitrogen and oxygen mixture;

means for mixing the gaseous nitrogen, carbon dioxide and the oxygen containing gas to form the fire extinguishing gas mixture;

means for heating the fire extinguishing gas mixture to a temperature of from greater than 0° C. to about +35° C.; and means for delivering the fire extinguishing gas mixture to the fire zone;

the nitrogen, carbon dioxide and the oxygen being delivered to the fire zone in the gaseous proportions of from about 81 to about 88% by volume nitrogen, of from about 2 to about 5% by volume of carbon dioxide and of from about 10 to about 15% by volume of oxygen.

20. A transportable system for delivering to an enclosed fire zone a breathable, fire extinguishing gas mixture, which gas mixture comprises nitrogen, carbon dioxide and oxygen and which system comprises:

a device for generating a nitrogen rich gaseous stream selected from the group consisting of a pressure swing adsorption unit, a vacuum swing adsorption unit and a membrane unit;

a storage vessel for storing the carbon dioxide;

a source of an oxygen containing gas selected from the group consisting of ambient air and an oxygen containing stream obtained from a device selected from the group consisting of a pressure swing adsorption unit, a vacuum swing adsorption unit and a membrane unit, means for mixing the nitrogen rich stream with the oxygen containing gas is thereby controlling the proportions of oxygen and nitrogen in the mixture so formed;

means for introducing the carbon dioxide into the nitrogen and oxygen mixture;

means for mixing the gaseous nitrogen, carbon dioxide and the oxygen containing gas;

means for heating the fire extinguishing gas mixture to a temperature of from greater than 0° C. to about +35° C.; and means for delivering the gaseous mixture to the fire zone, the nitrogen, carbon dioxide and the oxygen being delivered to the fire zone in the gaseous proportions of from about 81 to about 88% by volume nitrogen, of from about 2 to about 5% by volume of carbon dioxide and of from about 10 to about 15% by volume of oxygen.

* * * * *